US008863636B2

(12) United States Patent
Ahn et al.

(10) Patent No.: US 8,863,636 B2
(45) Date of Patent: Oct. 21, 2014

(54) SOFT RECOIL SYSTEM AND CANNON HAVING THE SAME

(71) Applicants: Sang-Tae Ahn, Daejeon (KR); Kuk-Jeong Kang, Daejeon (KR); Chang-Ki Cho, Daejeon (KR); Sang-Bae Jun, Gyeongsangnam-Do (KR)

(72) Inventors: Sang-Tae Ahn, Daejeon (KR); Kuk-Jeong Kang, Daejeon (KR); Chang-Ki Cho, Daejeon (KR); Sang-Bae Jun, Gyeongsangnam-Do (KR)

(73) Assignee: Agency for Defense Development (KR)

( * ) Notice: Subject to any disclaimer, the term of this patent is extended or adjusted under 35 U.S.C. 154(b) by 48 days.

(21) Appl. No.: 13/678,674

(22) Filed: Nov. 16, 2012

(65) Prior Publication Data

US 2013/0269507 A1 Oct. 17, 2013

(30) Foreign Application Priority Data

Apr. 16, 2012 (KR) ..... 10-2012-0039384

(51) Int. Cl.
*F41A 25/02* (2006.01)
*F41A 19/58* (2006.01)
*F41A 25/00* (2006.01)

(52) U.S. Cl.
CPC ..... *F41A 25/00* (2013.01); *F41A 19/58* (2013.01); *F41A 25/02* (2013.01)
USPC ..... 89/43.01

(58) Field of Classification Search
USPC ..... 89/1.7, 1.701–1.705, 42.01, 42.03, 89/43.01, 27.11
See application file for complete search history.

(56) References Cited

U.S. PATENT DOCUMENTS 5,220,126 A * 6/1993 Borgwarth et al. ..... 89/28.05
5,463,928 A 11/1995 Boggavarapu et al. ..... 89/8
8,468,928 B2 * 6/2013 Wynes et al. ..... 89/43.01

FOREIGN PATENT DOCUMENTS

KR 1995-0019619 7/1995
KR 1995-0019622 7/1995
KR 1995-0019623 7/1995
KR 1996-0002128 2/1996
KR 10-0415049 1/2004

OTHER PUBLICATIONS

Kyu Jin Park, "Development of the surveillance robot using Virtual Engineering," Department of Mechatronics Engineering, Graduate School, Chungnam National University, Daejon, Korea, 75 pages, Feb. 2009, (with English Abstract).
Heung-Tae Kim et al., "Structural and dynamic analysis on the Latch of Soft Recoil System under Impact," pp. 875-879, 2010, (with English Abstract).

* cited by examiner

*Primary Examiner* — Reginald Tillman, Jr.
(74) *Attorney, Agent, or Firm* — Ostrolenk Faber LLP

(57) ABSTRACT

Disclosed are a soft recoil system and a cannon having the same. The soft recoil system includes: a cannon barrel returning device mounted to a recoil device for absorbing a recoil force occurring when ammunition is fired, and configured to backward press a breech ring, such that the cannon barrel is fixed to a preset position; a cannon barrel fixing device installed at the recoil device, and configured to fix the cannon barrel when the cannon barrel returns to the fixed position; and a forward momentum generator connected to the recoil device and the breech ring, respectively, configured to forward move the cannon barrel by applying a force to the breech ring, such that the ammunition is fired while the cannon barrel forward moves, and configured to reduce a recoil force by partially attenuating recoil momentum resulting from the firing of the ammunition, by forward momentum.

18 Claims, 8 Drawing Sheets

SOFT RECOIL SYSTEM AND CANNON HAVING THE SAME

CROSS-REFERENCE TO RELATED APPLICATION

Pursuant to 35 U.S.C. §119(a), this application claims the benefit of earlier filing date and right of priority to Korean Application No. 10-2012-0039384, filed on Apr. 16, 2012, the contents of which is incorporated by reference herein in its entirety.

BACKGROUND OF THE INVENTION

1. Field of the Invention

The present disclosure relates to a soft recoil system capable of reducing a recoil force and a recoil distance, and a cannon having the same.

2. Background of the Invention

In the process of firing ammunition, a force having the same intensity as that of a force which has been applied to the ammunition is applied to a cannon barrel according to the law of action and reaction. Due to such force, the cannon barrel moves in the opposite direction to the firing direction of the ammunition (recoil). Therefore, the cannon barrel which has backward moved, should return to the original position (counter recoil).

Generally, a cannon mounted to a tank is fired in a stationary state. In this case, a recoil load occurring during the firing is about 100 tons based on a 120-mm tank gun, which always results in a backward motion of the cannon barrel by a considerable distance. Accordingly, used is a counter-recoil device for moving the cannon barrel to the original position.

In order to reduce a recoil force of a cannon, a method for delaying a firing impact force for a predetermined time may be considered. However, this method can be implemented only by increasing a recoil distance. Accordingly, may be considered a soft recoil system capable of reducing not only a recoil force but also a recoil distance against recoil, and a cannon having the same.

SUMMARY OF THE INVENTION

Therefore, an aspect of the detailed description is to provide a soft recoil system capable of reducing not only a recoil force but also a recoil distance, and a cannon having the same.

To achieve these and other advantages and in accordance with the purpose of this specification, as embodied and broadly described herein, there is is provided a soft recoil system, comprising: a cannon barrel returning device mounted to a recoil device for absorbing a recoil force occurring when ammunition is fired, and configured to backward press a breech ring coupled to a rear end of a cannon barrel, such that the cannon barrel is fixed to a preset position; a cannon barrel fixing device installed at the recoil device, and configured to fix the cannon barrel when the cannon barrel returns to the fixed position; and a forward momentum generator connected to the recoil device and the breech ring, respectively, configured to forward move the cannon barrel by applying a force to the breech ring, such that the ammunition is fired while the cannon barrel forward moves, and configured to reduce a recoil force by partially attenuating recoil momentum resulting from the firing of the ammunition, by forward momentum.

According to an embodiment of the present invention, the soft recoil system may further comprise a firing device installed at a bracket coupled to the recoil device, and configured to fire the ammunition by coming in electrical contact with the breech ring, while the breech ring forward moves by the forward momentum generator.

According to another embodiment of the present invention, the cannon barrel fixing device may be formed to extend towards the breech ring, and may be configured to fix the cannon barrel in a fixing manner by the breech ring when the cannon barrel returns to the fixed position.

The cannon barrel fixing device may include a fixing unit mounted to the recoil device; and a rotation unit rotatably connected to the fixing unit, and formed to be locked by the breech ring when rotating in one direction, and to be unlocked when rotating in another direction.

The part of the breech ring locked by the cannon barrel fixing unit, may be is fixed to the cannon barrel fixing device, by backward moving via the cannon barrel fixing unit when the cannon is recoiled due to the firing of the ammunition, and then by forward moving by the forward momentum generator.

According to another embodiment of the present invention, the cannon barrel returning device may include a first cylinder mounted to the recoil device; and a first piston formed to be moveable along a shaft of the first cylinder, controlled by air pressure or hydraulic pressure, and configured to press the breech ring such that the cannon barrel is located at the fixed position.

The first piston may return to an initial position when the cannon barrel is fixed by the cannon barrel fixing device, and may be disposed between the recoil device and the breech ring at the initial position. When the ammunition is mis-fired, the first piston may contact the breech ring so as to absorb a force transmitted to the breech ring.

The forward momentum generator may include a second cylinder mounted to the recoil device; and a second piston formed to be moveable along a shaft of the second cylinder, mounted to the breech ring, controlled by air pressure or hydraulic pressure, and configured to forward move the cannon barrel by pulling the breech ring.

According to another embodiment of the present invention, each of the cannon barrel returning device and the forward momentum generator may be provided in two in a symmetric manner with each other with respect to a shaft of the cannon barrel, such that the breech ring is applied with a uniform force.

According to another aspect of the present invention, there is provided a soft recoil system, comprising: a recoil motion unit returning device configured to backward press a recoil motion unit, such that the recoil motion unit is fixed to a preset position; a recoil motion unit fixing device configured to fix the recoil motion unit when the recoil motion unit returns to the fixed position; a forward momentum generator configured to forward move the recoil motion unit by applying a force to the recoil motion unit, such that ammunition is fired while the recoil motion unit forward moves, and configured to reduce a recoil force by partially attenuating recoil momentum resulting from the firing of the ammunition, by forward momentum; and a firing device configured to fire the ammunition by being interworked with the recoil motion unit, while the recoil motion unit forward moves by the forward momentum generator.

To achieve these and other advantages and in accordance with the purpose of this specification, as embodied and broadly described herein, there is also provided a cannon, comprising: a cannon barrel formed to extend in one direction such that an ammunition is fired along a specific direction; a breech ring coupled to a rear end of the canon barrel, and performing a recoil motion and a counter recoil motion together with the cannon barrel; a recoil device mounted to the cannon barrel, and configured to absorb a recoil force occurring when the ammunition is fired; a cannon barrel returning device mounted to the recoil device, and configured to backward press the breech ring such that the cannon barrel is fixed to a preset position; a cannon barrel fixing device installed at the recoil device, and configured to fix the cannon barrel in a fixing manner by the breech ring when the cannon barrel returns to the fixed position; and a forward momentum generator connected to the recoil device and the breech ring, respectively, configured to forward move the cannon barrel by applying a force to the breech ring, such that the ammunition is fired while the cannon barrel forward moves, and configured to reduce a recoil force by partially attenuating recoil momentum resulting from the firing of the ammunition, by forward momentum.

According to an embodiment of the present invention, the cannon may further comprise a bracket mounted to the recoil device, and performing a relative motion with the breech ring when the ammunition is fired; and a firing device installed at the bracket, and configured to fire the ammunition by coming in electrical contact with the breech ring, while the breech ring forward moves by the forward momentum generator.

According to another embodiment of the present invention, the cannon barrel fixing device may be formed to extend towards the breech ring, and may be configured to fix the cannon barrel in a fixing manner by the breech ring, when the cannon barrel returns to the fixed position.

The cannon barrel fixing device may include a fixing unit mounted to the recoil device; and a rotation unit rotatably connected to the fixing unit, and formed to be locked by the breech ring when rotating in one direction, and to be unlocked when rotating in another direction.

The part of the breech ring locked by the cannon barrel fixing unit, may be fixed to the cannon barrel fixing device, by backward moving via the cannon barrel fixing unit when the cannon is recoiled due to the firing of the ammunition, and then by forward moving by the forward momentum generator.

According to another embodiment of the present invention, the cannon barrel returning device may include a first cylinder mounted to the recoil device; and a first piston formed to be moveable along a shaft of the first cylinder, controlled by air pressure or hydraulic pressure, and configured to backward press the breech ring such that the cannon barrel is located at the fixed position.

The first piston may return to an initial position when the cannon barrel is fixed by the cannon barrel fixing device, and may be disposed between the recoil device and the breech ring at the initial position. When the ammunition is mis-fired, the first piston may contact the breech ring so as to absorb a force transmitted to the breech ring.

The forward momentum generator may include a second cylinder mounted to the recoil device; and a second piston formed to be moveable along a shaft of the second cylinder, mounted to the breech ring, controlled by air pressure or hydraulic pressure, and configured to forward move the cannon barrel by pulling the breech ring.

According to another embodiment of the present invention, each of the cannon barrel returning device and the forward momentum generator may be provided in two in a symmetric manner with each other with respect to a shaft of the cannon barrel, such that the breech ring is applied with a uniform force.

The cannon barrel returning device and the forward momentum generator may be sequentially disposed along an outer circumferential surface of the cannon barrel.

Further scope of applicability of the present application will become more apparent from the detailed description given hereinafter. However, it should be understood that the detailed description and specific examples, while indicating preferred embodiments of the invention, are given by way of illustration only, since to various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a soft recoil system and a cannon having the same according to the present invention will be explained in more details with reference to the attached drawings.

A singular expression of this specification includes a plural meaning unless there is a contextually distinctive difference therebetween.

Figure 1:
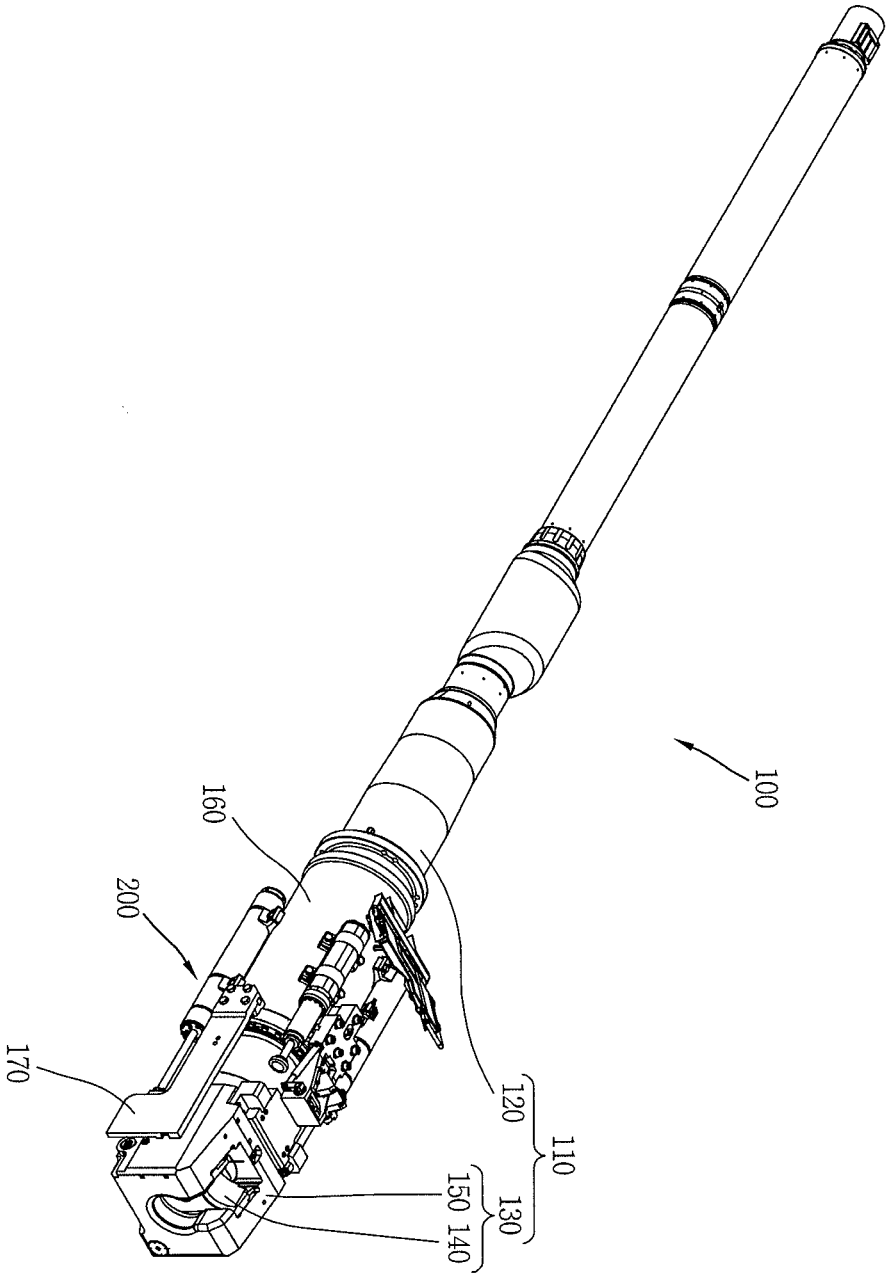
FIG. 1 is a perspective view showing a cannon according to an embodiment of the present invention.

FIG. 1 is a perspective view showing a cannon according to an embodiment of the present invention.

Referring to FIG. 1, a cannon 100 indicates a large firearm for firing ammunition by a force of gas occurring when an explosive is exploded in a pipe having one blocked side. The cannon 100 may be implemented as a tank gun or a machine gun. The cannon 100 includes a recoil motion unit 110, a recoil device 160, and a soft recoil system 200.

The recoil motion unit 110 is configured to fire ammunition. A force having the same size as that applied to the ammunition is applied to the recoil motion unit 110 according to the law of action and reaction while the ammunition is fired, so that the recoil motion unit 110 moves in the opposite direction to the firing direction of the ammunition (recoil). The recoil motion unit 110 is provided with a cannon barrel 120 and a breech device 130.

The cannon barrel 120 is formed to extend to one direction such that ammunition is fired along a specific direction. The cannon barrel 120 may be provided with rifle therein.

The breech device 130 consists of a breech block 140 and a breech ring 150 for accommodating the breech block 140 therein. The breech block 140 is configured to open and close a rear side of a cartridge chamber of the cannon barrel 120 for loading of ammunition. The breech ring 140 is configured to accommodate therein a rear end of the cannon barrel 120 and the breech block 140, and to backward move (recoil) and forward move (counter recoil) in a restricted state with respect to the cannon barrel 120.

The cannon barrel 120 is mounted to a cannon holder (not shown). An inclined angle of the cannon holder with respect to the ground can be controlled such that the mounted cannon barrel 120 is towards a specific firing direction.

The recoil device 160 is mounted to the cannon barrel 120, and is configured to absorb a firing impact force, i.e., a recoil force occurring when ammunition is fired. The recoil device 160 may be formed to accommodate therein a rear end of the cannon barrel 120, and may be mounted to a cannon holder. The recoil device 160 and the cannon barrel 120 may have a structure of cylinder-piston operated by pressure of a fluid, and an oil feeder 161 for controlling recoil oil may be installed at the recoil device 160.

As aforementioned, the recoil motion unit 110 which has backward moved by firing of ammunition should return to the original position after the ammunition is fired (counter recoil). In order to move the recoil motion unit 110 to the original position, a counter-recoil device is generally used.

The cannon 100 according to an embodiment of the present invention includes a soft recoil system 200 capable of reducing a recoil force and a recoil distance against recoil. Hereinafter, the soft recoil system 200 will be explained in more details.

Figure 2:
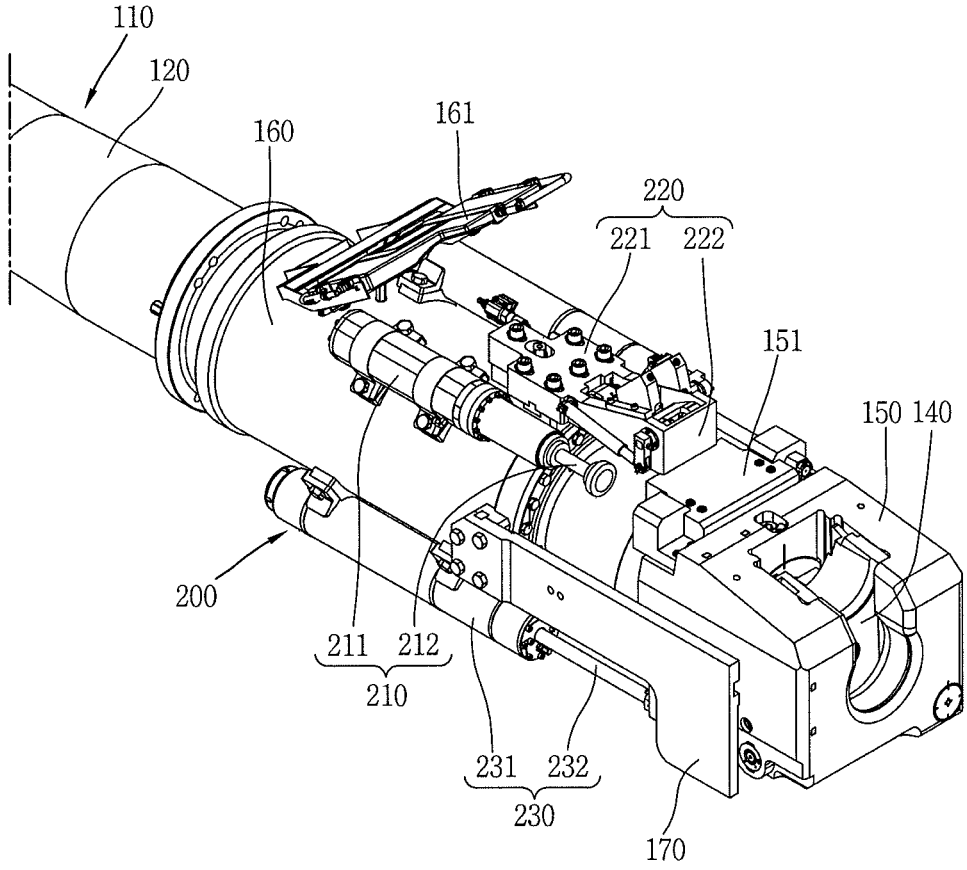
FIG. 2 is an enlarged view of a soft recoil system of FIG. 1.
Figure 3:
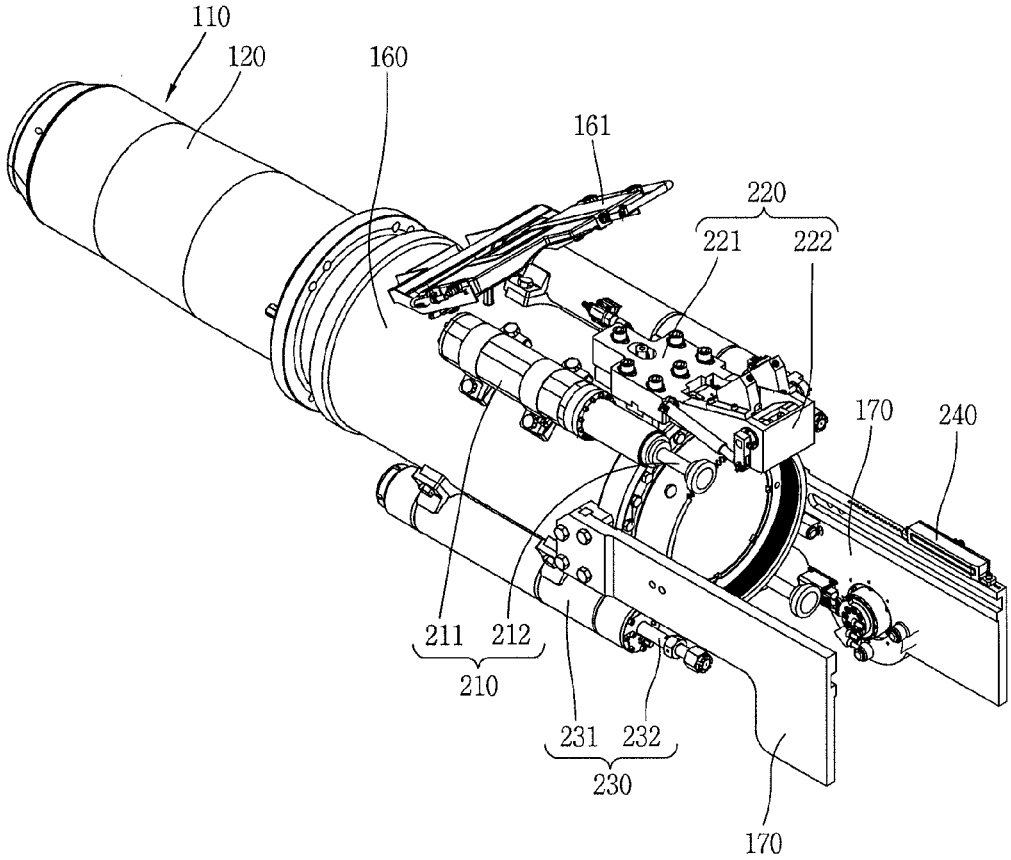
FIG. 3 is a conceptual view of FIG. 2, in which a breech device of a cannon is not illustrated.

FIG. 2 is an enlarged view of the soft recoil system 200 of FIG. 1. FIG. 3 is a conceptual view of FIG. 2, in which a breech device 130 of a cannon 100 is not illustrated. And, FIG. 4 is a conceptual view of FIG. 3, which is viewed from a rear end of the cannon 100.

Figure 4:
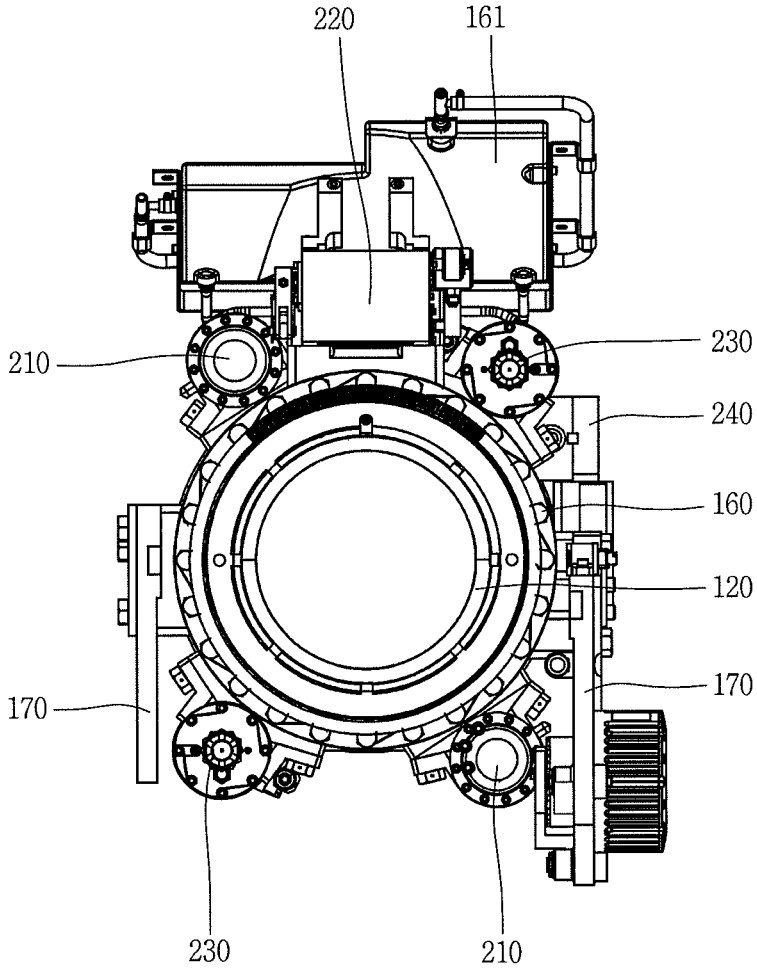
FIG. 4 is a conceptual view of FIG. 3, which is viewed from a rear end of a cannon.

Referring to FIGS. 2 to 4, the soft recoil system 200 is configured to fire ammunition while the recoil motion unit 110 forward moves. For instance, the soft recoil system 200 may be configured to forward accelerate the recoil motion unit 110 by applying a force to the recoil motion unit 110, and to fire ammunition when forward momentum is maximized. Under this configuration, part of recoil momentum generated from the recoil motion unit 110 is attenuated by the forward momentum. As a result, a recoil force and a recoil distance are reduced.

The structure of the soft recoil system 200 will be explained in more details. The soft recoil system 200 includes a cannon barrel returning device (or recoil motion unit returning device 210), a cannon barrel fixing device (or recoil motion unit fixing device 220), and a forward momentum generator 230.

The cannon barrel returning device 210 may be configured to backward press the breech ring 150, and the recoil motion unit 110 may be fixed to a preset position by the pressing. The fixed position indicates a position where the breech ring 150 is spaced from the recoil device 160 by a specific distance, such that the recoil motion unit 110 obtains a forward moving distance when ammunition is fired.

The cannon barrel returning device 210 may be mounted to the recoil device 160, and may be configured to push the cannon barrel ring 150. For instance, the cannon barrel returning device 210 may have a structure of cylinder-piston operated by pressure of a fluid. More specifically, the cannon barrel returning device 210 may include a first cylinder 211 mounted to the recoil device 160, and a first piston 212 formed to be moveable along a shaft of the first cylinder 211 in an accommodated state in the first cylinder 211. The first piston 212 may be configured to backward press the breech ring 150 by being controlled by air to pressure or hydraulic pressure, such that the cannon barrel 120 is located at the fixed position.

The cannon barrel fixing device 220 is configured to fix the recoil motion unit 110 when the recoil motion unit 110 returns to the fixed position. The cannon barrel fixing device 220 may be configured to fix the recoil motion unit 110 to the fixed position by a locking structure. For instance, the cannon barrel fixing device 220 may be mounted to an upper part of the recoil device 160 so as to extend towards the breech ring 150, and may be provided with a fixing unit 221 and a rotation unit 222. The fixing unit 221 is mounted to the recoil device 160. One end of the rotation unit 222 is rotatably connected to the fixing unit 221, and another end thereof serves to fix the recoil motion unit 110 by being locked by the breech ring 150. The rotation unit 222 may be formed to be locked by the breech ring 150 when rotating in one direction, and to be unlocked when rotating in another direction.

An adapter 151 is installed at an upper part of the breech ring 150 adjacent to the end of the cannon barrel fixing device 220, such that the cannon barrel fixing device 220 is locked and unlocked by the adapter 151. The adapter 151 serves to fix the recoil motion unit 110 together with the cannon barrel fixing device 220, at the time of applying the soft recoil system 200 to the cannon 100. Accordingly, if the cannon 100 is provided with the soft recoil system 200 from the beginning, the breech ring 150 itself may serve as the adapter 151.

The forward momentum generator 230 is configured to forward move the recoil motion unit 110, so that ammunition can be fired while the recoil motion unit 110 forward moves, and so that a recoil force can be reduced as recoil momentum is partially attenuated by forward momentum.

The forward momentum generator 230 may be connected to the recoil device 160 and the breech ring 150, respectively, and may be configured to forward move the cannon barrel 120 by applying a force to the breech ring 150. For instance, the forward momentum generator 230 may have a structure of cylinder-piston operated by pressure of a fluid. More specifically, the forward momentum generator 230 may include a second cylinder 231 mounted to the recoil device 160, and a second piston 232 formed to be moveable along a shaft of the second cylinder 231 in an accommodated state in the second cylinder 231. The second piston 232 is configured to forward move the cannon barrel 120 by pulling the breech ring 150, by being controlled by air pressure or hydraulic pressure.

Referring to FIG. 4, the cannon barrel returning device 210 may be formed in plurality in number. And, the cannon barrel returning device 210 may be provided in two in a symmetric manner with each other with respect to a shaft of the cannon barrel 120, so that a uniform force can be applied to the breech ring 150. Likewise, the forward momentum generator 230 may be formed in plurality in number. And, the forward momentum generator 230 may be provided in two in a symmetric manner with each other with respect to the shaft of the cannon barrel 120, so that a uniform force can be applied to the breech ring 150. When the cannon 100 is viewed from the rear end, the cannon barrel returning device 210 may be disposed at the left upper end and the right lower end, and the forward momentum generator 230 may be disposed at the left lower end and the right upper end.

A bracket 170 is mounted to the recoil device 160. The bracket 170 is spaced from the breech ring 150, and is configured to perform a relative motion with the breech ring 150 while ammunition is fired. As shown, the bracket 170 may be disposed at the right and left sides of the breech ring 150.

Since ammunition is fired while the recoil motion unit 110 forward moves, the soft recoil system 200 should control a firing time point. To this end, a firing device 240 for firing ammunition may be installed at the bracket 170. The firing is device 240 is configured to fire ammunition by being interworked with the breech ring 150, while the breech ring 150 forward moves by the forward momentum generator 230.

For instance, the firing device 240 may be configured to ignite ammunition by electrically contacting the breech ring 150. The firing time point may be controlled by adjusting a distance between the firing device 240 and the recoil motion unit 110. In the case of igniting ammunition using electric energy, a misfiring rate may be more reduced and ammunition may be fired in a simpler manner, than a case where ammunition is ignited by impact. Alternatively, the firing device 240 may be configured to ignite ammunition by applying an impact to the ammunition, in a mechanical contact manner with the breech ring 150.

Figure 5A:
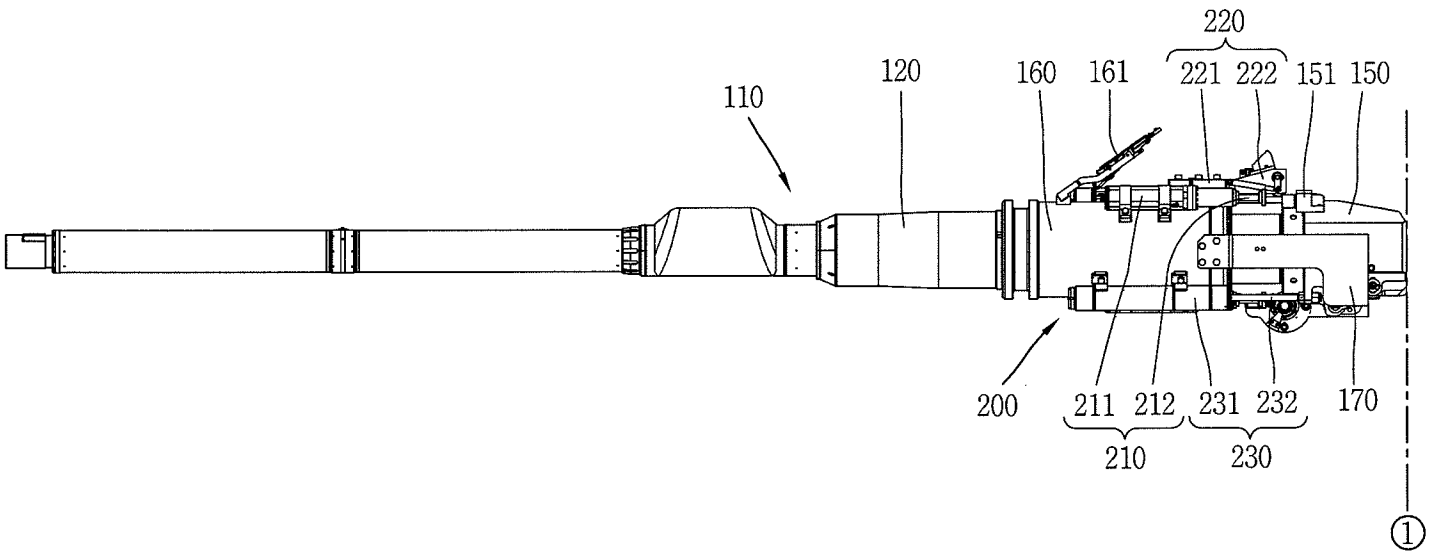
FIGS. 5A to 5D are flowcharts showing recoil and counter recoil operations of the cannon of FIG. 1 according to firing of ammunition.
Figure 5B:
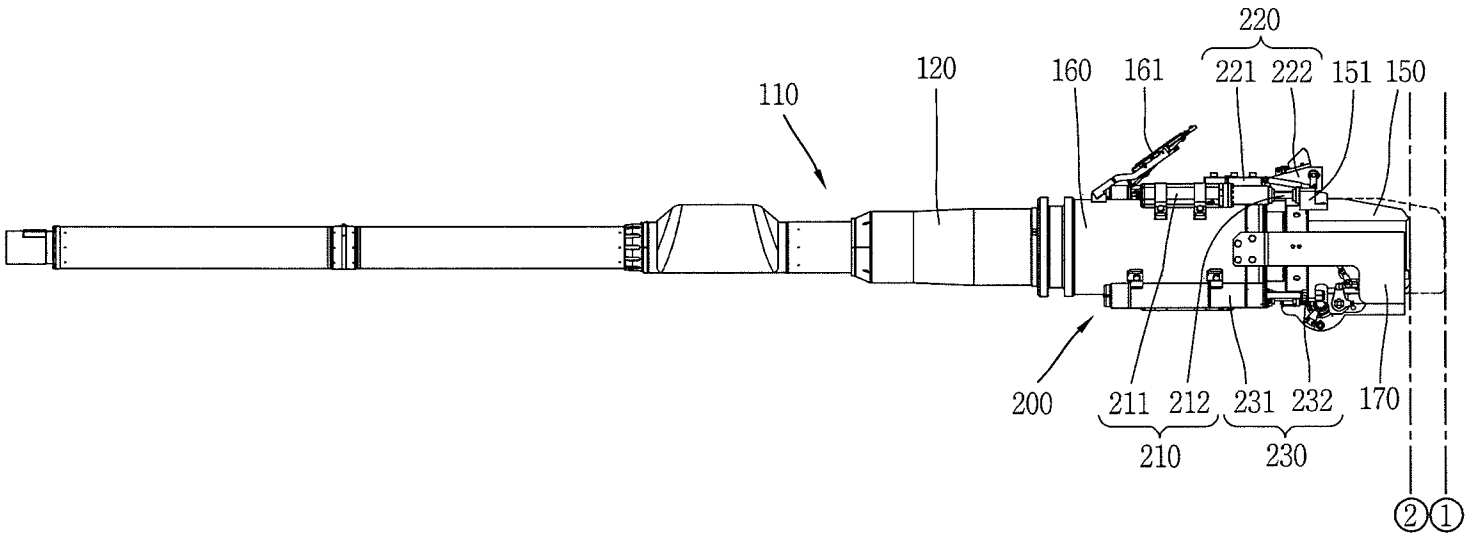
Figure 5C:
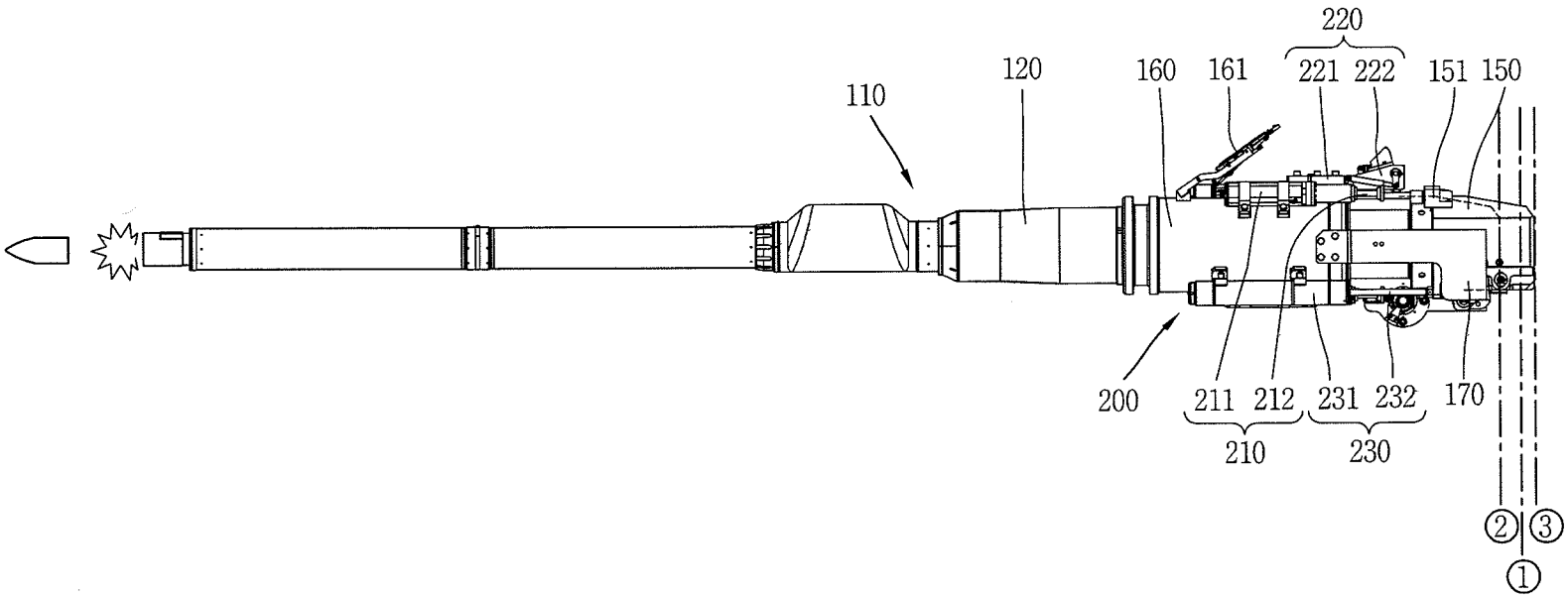
Figure 5D:
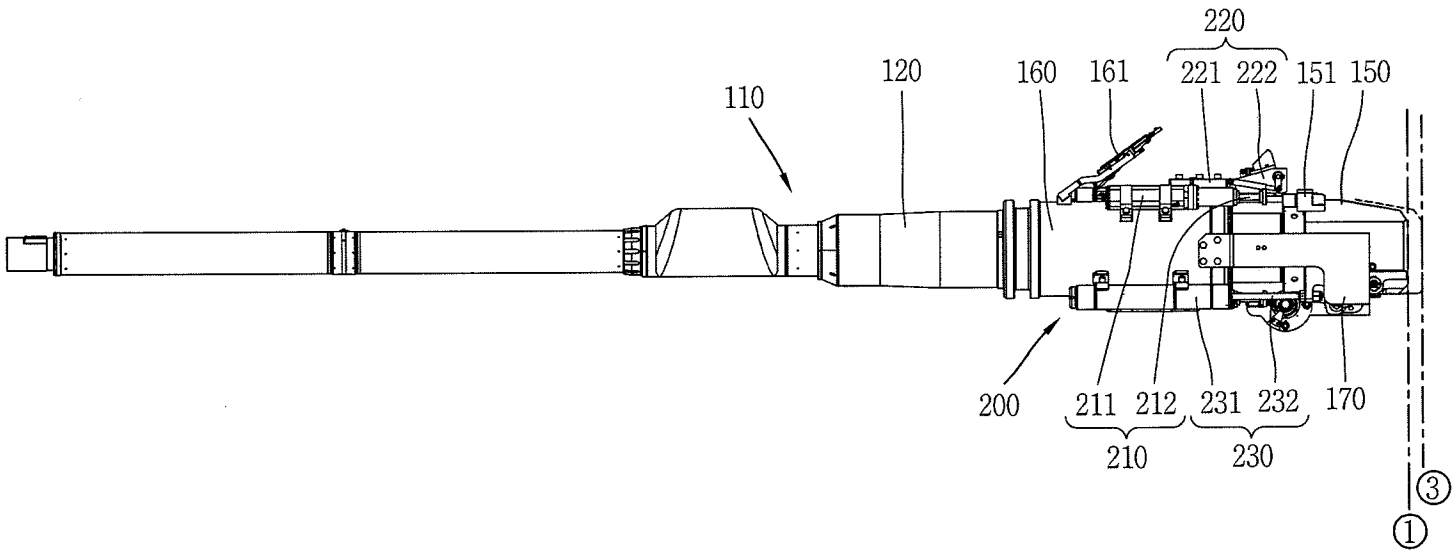

FIGS. 5A to 5D are flowcharts showing recoil and counter recoil operations of the cannon 100 of FIG. 1 according to firing of ammunition. FIG. 5A illustrates a state where the recoil motion unit 110 is fixed to a preset position before firing. FIG. 5B illustrates a state where ammunition is fired while the recoil motion unit 110 forward moves. FIG. 5C illustrates a state where the recoil motion unit 110 is recoiled by a recoil force. And, FIG. 5D illustrates a state where the recoil motion unit 110 is counter recoiled to be fixed to the preset position.

Referring to FIGS. 5A to 5D, before firing, the recoil motion unit returning device 210 recoils the recoil motion unit 110, so that the recoil motion unit 110 can to be fixed to a preset position. Once the recoil motion unit 110 is located at the preset position, the recoil motion unit fixing device 220 fixes the recoil motion unit 110. Referring to FIG. 5A, the rear end of the breech ring 150 is disposed on the position ①.

In the recoil motion unit returning device 210 having the first cylinder 211 and the first piston 212, the first piston 212 may return to the original position if the recoil motion unit 110 is fixed by the recoil motion unit fixing device 220. At the original position, the first piston 212 may be disposed between the recoil device 160 and the breech ring 150. And, the first piston 212 may be configured to absorb a force transmitted to the breech ring 150, by contacting the breech ring 150 when ammunition is not fired.

Upon occurrence of a firing command, the rotation unit 222 of the cannon barrel fixing device 220 rotates to one direction, so that a fixed state of the recoil motion unit 110 by the recoil motion unit fixing device 220 is released. And, the recoil motion unit 110 forward moves by the forward momentum generator 230. While forward moving, the recoil motion unit 110 electrically/mechanically contacts the firing device 240 so that ammunition can be fired. Referring to FIG. 5B, the rear end of the breech ring 150 is disposed on the position ②.

Upon firing, part of recoil momentum is attenuated by forward momentum thus to firstly reduce a recoil force. Then, the firstly-reduced recoil force is absorbed by the recoil device 160, thereby being secondarily reduced. Accordingly, the recoil motion unit 110 backward moves via the recoil motion unit fixing device 220 with the considerably reduced recoil force (refer to FIG. 5C). Referring to FIG. 5C, the rear end of the breech ring 150 is disposed on the position ③. Then, the recoil motion unit 110 forward moves by the forward momentum generator 230, and is locked by the rotation unit 222 having rotated to another direction. As the recoil motion unit 110 is fixed to the rotation unit 222, the firing is completed. Referring to FIG. 5D, the rear end of the breech ring 150 is again disposed on said position ①.

In the present invention, the recoil motion unit 110 backward moves by the recoil motion unit returning device 210 thus to be fixed to a preset position. While the recoil motion unit 110 forward moves by the forward momentum generator 230, ammunition is fired. Under this configuration, part of recoil momentum generated from the recoil motion unit 110 is attenuated by forward momentum. As a result, a recoil force and a recoil distance are reduced.

The soft recoil system 200 of the present invention may be applied not only to the cannon 100 of the present invention, but also to all types of firearms. Especially, in case of mounting the cannon 100 having the soft recoil system 200 to a vehicle, the vehicle can have a more reduced entire weight when compared with the conventional one, and equipment operation costs can be reduced.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A soft recoil system, comprising:

a cannon barrel returning device mounted to a recoil device for absorbing a recoil force occurring when ammunition is fired, and configured to backwardly press a breech ring coupled to a rear end of a cannon barrel, such that the cannon barrel is located to a preset position;

a cannon barrel fixing device installed at the recoil device, and configured to fix the cannon barrel when the cannon barrel returns to the preset position;

a forward momentum generator connected to the recoil device and the breech ring, respectively, configured to forwardly move the cannon barrel by applying a force to the breech ring, such that the ammunition is fired while the cannon barrel moves forward, and configured to reduce a recoil force by partially attenuating recoil momentum resulting from the firing of the ammunition, by forward momentum; and a firing device installed at a bracket coupled to the recoil device, and configured to fire the ammunition by coming in contact with the breech ring while the breech ring moves forward by the forward momentum generator.

2. The soft recoil system of claim 1, wherein the cannon barrel fixing device is formed to extend towards the breech ring, and is configured to fix the cannon barrel in a fixing manner by the breech ring when the cannon barrel returns to the preset position.

3. The soft recoil system of claim 2, wherein the cannon barrel fixing device includes:

a fixing unit mounted to the recoil device; and a rotation unit rotatably connected to the fixing unit, and formed to be locked by the breech ring when rotating in one direction, and to be unlocked when rotating in another direction.

4. The soft recoil system of claim 2, wherein the part of the breech ring locked by the cannon barrel fixing unit, is fixed to the cannon barrel fixing device, by moving backward via the cannon barrel fixing unit when the cannon is recoiled due to the firing of the ammunition, and then by moving forward by the forward momentum generator.

5. The soft recoil system of claim 1, wherein the cannon barrel returning device includes:

a first cylinder mounted to the recoil device; and a first piston formed to be moveable along a shaft of the first cylinder, controlled by air pressure or hydraulic pressure, and configured to press the breech ring such that the cannon barrel is located at the preset position.

6. The soft recoil system of claim 5, wherein the first piston returns to an initial position when the cannon barrel is fixed by the cannon barrel fixing device, and wherein the first piston is disposed between the recoil device and the breech ring at the initial position, and contacts the breech ring so as to absorb a force transmitted to the breech ring when the ammunition is mis-fired.

7. The soft recoil system of claim 5, wherein the forward momentum generator includes:

a second cylinder mounted to the recoil device; and a second piston formed to be moveable along a shaft of the second cylinder, mounted to the breech ring, controlled by air pressure or hydraulic pressure, and configured to move forwardly the cannon barrel by pulling the breech ring.

8. The soft recoil system of claim 1, wherein each of the cannon barrel returning device and the forward momentum generator is provided in two in a symmetric manner with each other with respect to a shaft of the cannon barrel, such that the breech ring is applied with a uniform force.

9. A soft recoil system, comprising:

a recoil motion unit returning device configured to backwardly press a recoil motion unit, such that the recoil motion unit is located to a preset position;

a recoil motion unit fixing device configured to fix the recoil motion unit when the recoil motion unit returns to the preset position;

a forward momentum generator configured to forwardly move the recoil motion unit by applying a force to the recoil motion unit, such that ammunition is fired while the recoil motion unit moves forward, and configured to reduce a recoil force by partially attenuating recoil momentum resulting from the firing of the ammunition, by forward momentum; and a firing device configured to fire the ammunition by coming in electrical contact with the recoil motion unit, while the recoil motion unit moves forward by the forward momentum generator.

10. A cannon, comprising:

a cannon barrel formed to extend in one direction such that an ammunition is fired along a specific direction;

a breech ring coupled to a rear end of the canon barrel, and performing a recoil motion and a counter recoil motion together with the cannon barrel;

a recoil device mounted to the cannon barrel, and configured to absorb a recoil force occurring when the ammunition is fired;

a cannon barrel returning device mounted to the recoil device, and configured to backwardly press the breech ring such that the cannon barrel is located to a preset position;

a cannon barrel fixing device installed at the recoil device, and configured to fix the cannon barrel when the cannon barrel returns to the preset position;

a forward momentum generator connected to the recoil device and the breech ring, respectively, configured to forwardly move the cannon barrel by applying a force to the breech ring, such that the ammunition is fired while the cannon barrel moves forward, and configured to reduce a recoil force by partially attenuating recoil momentum resulting from the firing of the ammunition, by forward momentum;

a bracket mounted to the recoil device, and performing a relative motion with the breech ring when the ammunition is fired; and a firing device installed at the bracket, and configured to fire the ammunition by coming in contact with the breech ring while the breech ring moves forward by the forward momentum generator.

11. The cannon of claim 10, wherein the cannon barrel fixing device is formed to extend towards the breech ring, and is configured to fix the cannon barrel in a fixing manner by the breech ring, when the cannon barrel returns to the preset position.

12. The cannon of claim 11, wherein the cannon barrel fixing device includes:

a fixing unit mounted to the recoil device; and a rotation unit rotatably connected to the fixing unit, and formed to be locked by the breech ring when rotating in one direction, and to be unlocked when rotating in another direction.

13. The cannon of claim 11, wherein the part of the breech ring locked by the cannon barrel fixing unit, is fixed to the cannon barrel fixing device, by moving backward via the cannon barrel fixing unit when the cannon is recoiled due to the firing of the ammunition, and then by moving forward by the forward momentum generator.

14. The cannon of claim 10, wherein the cannon barrel returning device includes:

a first cylinder mounted to the recoil device; and a first piston formed to be moveable along a shaft of the first cylinder, controlled by air pressure or hydraulic pressure, and configured to press the breech ring such that the cannon barrel is located at the preset position.

15. The cannon of claim 14, wherein the first piston returns to an initial position when the cannon barrel is fixed by the cannon barrel fixing device, and wherein the first piston is disposed between the recoil device and the breech ring at the initial position, and contacts the breech ring so as to absorb a force transmitted to the breech ring when the ammunition is mis-fired.

16. The cannon of claim 14, wherein the forward momentum generator includes:

a second cylinder mounted to the recoil device; and a second piston formed to be moveable along a shaft of the second cylinder, mounted to the breech ring, controlled by air pressure or hydraulic pressure, and configured to forwardly move the cannon barrel by pulling the breech ring.

17. The cannon of claim 10, wherein each of the cannon barrel returning device and the forward momentum generator is provided in two in a symmetric manner with each other with respect to a shaft of the cannon barrel, such that the breech ring is applied with a uniform force.

18. The cannon of claim 17, wherein the cannon barrel returning device and the forward momentum generator are sequentially disposed along an outer circumferential surface of the cannon barrel.

* * * * *